US012742333B2

(12) United States Patent
Chevis

(10) Patent No.: US 12,742,333 B2
(45) Date of Patent: Sep. 22, 2026

(54) SCISSOR ACTION STRIPPING CORNER

(71) Applicant: Apache Industrial Services, Inc., Houston, TX (US)

(72) Inventor: Kenneth M. Chevis, Houston, TX (US)

(73) Assignee: Apache Industrial Services, Inc., Houston, TX (US)

( * ) Notice: Subject to any disclaimer, the term of this patent is extended or adjusted under 35 U.S.C. 154(b) by 106 days.

(21) Appl. No.: 18/946,413

(22) Filed: Nov. 13, 2024

(65) Prior Publication Data

US 2025/0067068 A1 Feb. 27, 2025

Related U.S. Application Data

(62) Division of application No. 17/458,705, filed on Aug. 27, 2021, now Pat. No. 12,168,880.

(60) Provisional application No. 63/072,135, filed on Aug. 29, 2020.

(51) Int. Cl.
*E04G 11/08* (2006.01)
*E04G 17/00* (2006.01)

(52) U.S. Cl.
CPC ..... *E04G 11/08* (2013.01); *E04G 17/001* (2013.01)

(58) Field of Classification Search
CPC ..... E04G 11/08; E04G 11/082; E04G 15/063; E04G 17/001; E04G 13/02; E04G 19/00; F16H 1/12; B25B 17/00
USPC ..... 81/57.31; 74/134, 143
See application file for complete search history.

(56) References Cited

U.S. PATENT DOCUMENTS

| | | | | |
|---|---|---|---|---|
| 4,545,268 | A * | 10/1985 | Stuckey | B25B 17/00 81/57.31 |
| 4,666,643 | A * | 5/1987 | Spencer | E04G 13/02 264/32 |
| 5,088,578 | A * | 2/1992 | Gates | E04G 11/06 249/20 |
| 5,230,907 | A * | 7/1993 | Strickland | E04G 11/082 249/161 |
| 9,086,103 | B2 * | 7/2015 | Takada | F16H 31/001 |
| 10,753,108 | B2 * | 8/2020 | Baum | E04G 17/001 |
| 2019/0134847 | A1 * | 5/2019 | Kloss | B28B 7/0044 |
| 2019/0383044 | A1 * | 12/2019 | Johnson | E04G 13/02 |
| 2021/0164245 | A1 * | 6/2021 | Renz | B28B 7/0014 |
| 2023/0304310 | A1 * | 9/2023 | Core | E04G 9/08 |

FOREIGN PATENT DOCUMENTS

| | | | | |
|---|---|---|---|---|
| WO | WO-2013126695 | A1 * | 8/2013 | F16H 48/40 |

* cited by examiner

*Primary Examiner* — Beth A Aubrey
(74) *Attorney, Agent, or Firm* — Lerner David LLP

(57) ABSTRACT

Implementations of the of the present stripping corner may include a first forward surface, a second forward surface, hingedly connected to the first forward surface, a first rearward surface, hingedly connected to the first forward surface, a second rearward surface hingedly connected to the second forward surface, and an extender coupling the first rearward surface to the second rearward surface. The extender may be configured to receive an input torque about a first axis and may be configured to provide an output force along a second axis. The first axis may be substantially perpendicular to the second axis.

11 Claims, 8 Drawing Sheets

SCISSOR ACTION STRIPPING CORNER

CROSS-REFERENCE TO RELATED APPLICATIONS

This application is a divisional of U.S. patent application Ser. No. 17/458,705, filed on Aug. 27, 2021, entitled "Scissor Action Stripping Corner", which claims priority to U.S. Provisional Patent Application No. 62/072,135, filed on Aug. 29, 2020, entitled "Scissor Action Stripping Corner", the contents of both of which are hereby incorporated in their entirety.

FIELD

The present disclosure is directed toward stripping corners for formwork structures.

BACKGROUND

This section is intended to provide background information to facilitate a better understanding of various technologies described herein. As the section's title implies, this is a discussion of related art. That such art is related in no way implies that it is prior art. The related art may or may not be prior art. It should therefore be understood that the statements in this section are to be read in this light, and not as admissions of prior art.

During construction of a building, interior and exterior wall formworks should be erected in advance and set apart at a specific distance, so as to allow concrete to be poured in the space between the interior and exterior wall formworks. After the concrete hardens, the exterior wall formwork can be removed easily without the constraint of working space. However, the removal of the interior wall formwork is difficult due to the constraint of space and usually requires a worker to pry the formwork open, and thus it will likely generate side pressure against the wall that hasn't hardened completely, causing damage to the wall. The removal of the interior wall generally needs 24 hours after the concrete hardens, and it is really time consuming.

SUMMARY

An implementation of the of the present stripping corner may include a first forward surface, a second forward surface, hingedly connected to the first forward surface, a first rearward surface, hingedly connected to the first forward surface, a second rearward surface hingedly connected to the second forward surface, and an extender coupling the first rearward surface to the second rearward surface. The extender may be configured to receive an input torque about a first axis and may be configured to provide an output force along a second axis. The first axis may be substantially perpendicular to the second axis.

The extender may be configured to increase and decrease a distance between the first rearward surface and the second rearward surface. The extender may be a scissor jack and may include a screw and bolt assembly configured to translate the input torque into the output force. A screw of the screw and bolt assembly may be parallel to the first axis.

The implementation of the stripping corner may further include a sleeve around at least a portion of the screw. The screw may be coupled at a first end region of the screw to the extender and may be uncoupled at a second end region of the screw.

The implementation of the stripping corner may further include a bolthead rotationally fixed to the screw and connected to the screw at a first end of the screw and may further include a second extender coupling the first rearward surface to the second rearward surface. The second extender may be configured to receive a second input torque about the first axis and may be configured to provide a second output force along the second axis.

A further implementation of the stripping corner may include a first forward surface, a second forward surface, hingedly connected to the first forward surface, a first rearward surface, hingedly connected to the first forward surface, a second rearward surface hingedly connected to the second forward surface, and a first extender coupling the first rearward surface to the second rearward surface. The first extender may be configured to receive an input torque about a first axis and may be configured to provide an output force along a second axis. The first axis may be substantially perpendicular to the second axis. The further implementation may include a second extender coupling the first rearward surface to the second rearward surface. The second extender may be configured to receive an input torque about the first axis and may be configured to provide an output force along the second axis.

The first extender of the further implementation may include a first threaded fastener configured to actuate a first four bar linkage on the first extender, and the second extender may include a second threaded fastener configured to actuate a second four bar linkage on the second extender.

The further implementation of the stripping corner may include a first sleeve around the first threaded fastener and a second sleeve around the second threaded fastener. The first threaded fastener may be coupled at a first end region of the first threaded fastener to the first extender and may be uncoupled at a second end of the first threaded fastener. The second threaded fastener may be coupled at a first end region of the second threaded fastener to the second extender and may be uncoupled at a second end of the second threaded fastener.

The further implementation of the stripping corner may include a first bolthead rotationally fixed to a first end of the first threaded fastener and a second bolthead rotationally fixed to a first end of the second threaded fastener. The first bolthead and second bolthead may both be configured to simultaneously receive a first input torque at the first bolthead and a second input torque at the second bolthead. The input torques may be supplied by a single torquing device.

A method for performing a pour process may include pouring a material into a formwork that is at least partially secured by a stripping corner, curing the material, receiving an input torque at the stripping corner about a first axis, and providing an output force along a second axis that is substantially perpendicular to the first axis. The stripping corner may be a scissor jack or a plurality of scissor jacks.

The above referenced summary section is provided to introduce a selection of concepts in a simplified form that are further described below in the detailed description section. Additional concepts and various other implementations are also described in the detailed description. The summary is not intended to identify key features or essential features of the claimed subject matter, nor is it intended to be used to limit the scope of the claimed subject matter, nor is it intended to limit the number of inventions described herein. Furthermore, the claimed subject matter is not limited to implementations that solve any or all disadvantages noted in any part of this disclosure.

BRIEF DESCRIPTION OF THE DRAWINGS

Implementations of various techniques will hereafter be described with reference to the accompanying drawings. It should be understood, however, that the accompanying drawings illustrate only the various implementations described herein and are not meant to limit the scope of various techniques described herein.

DETAILED DESCRIPTION

Figure 1A:
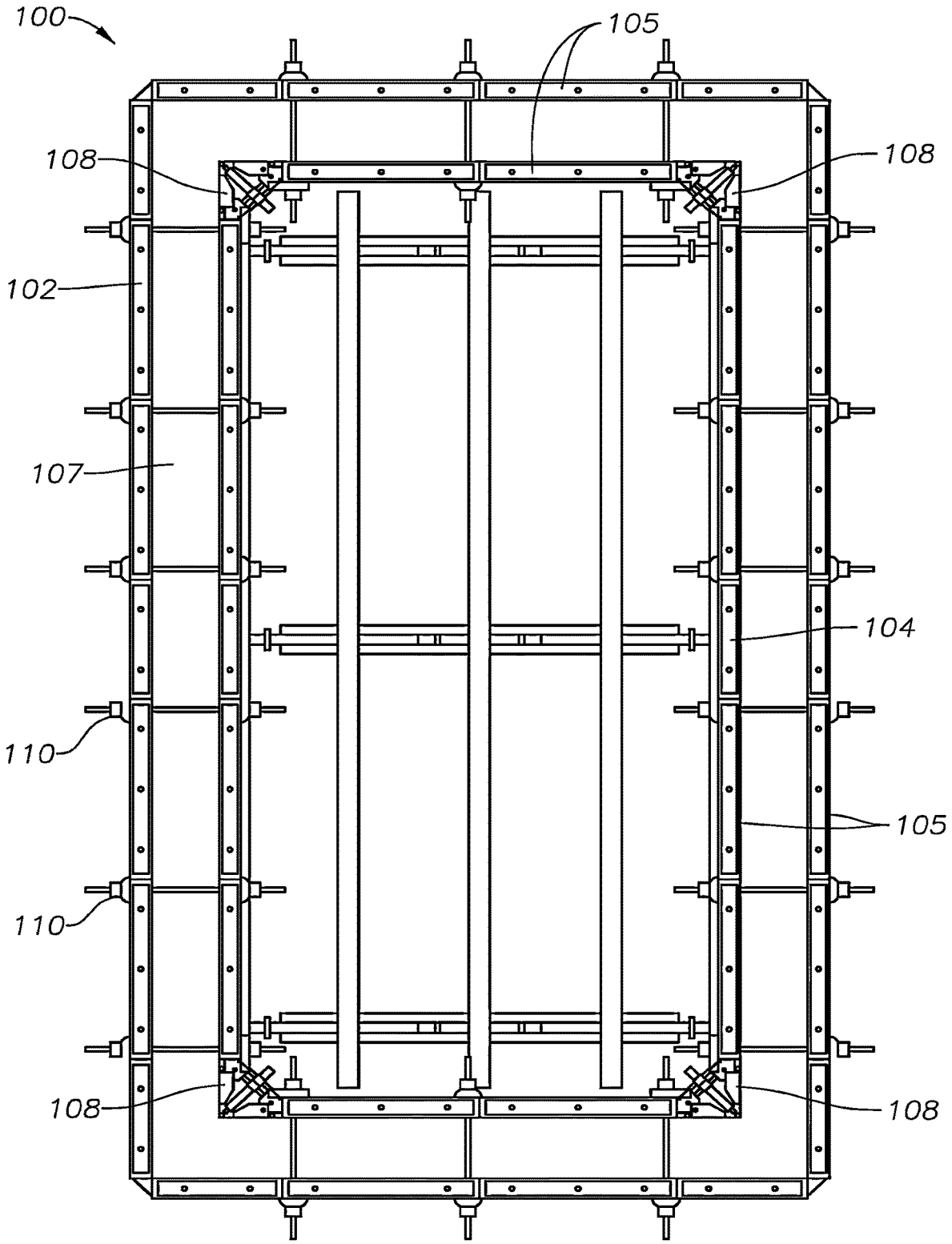
FIG. 1A illustrates an implementation of formwork in a pour position.
Figure 1B:
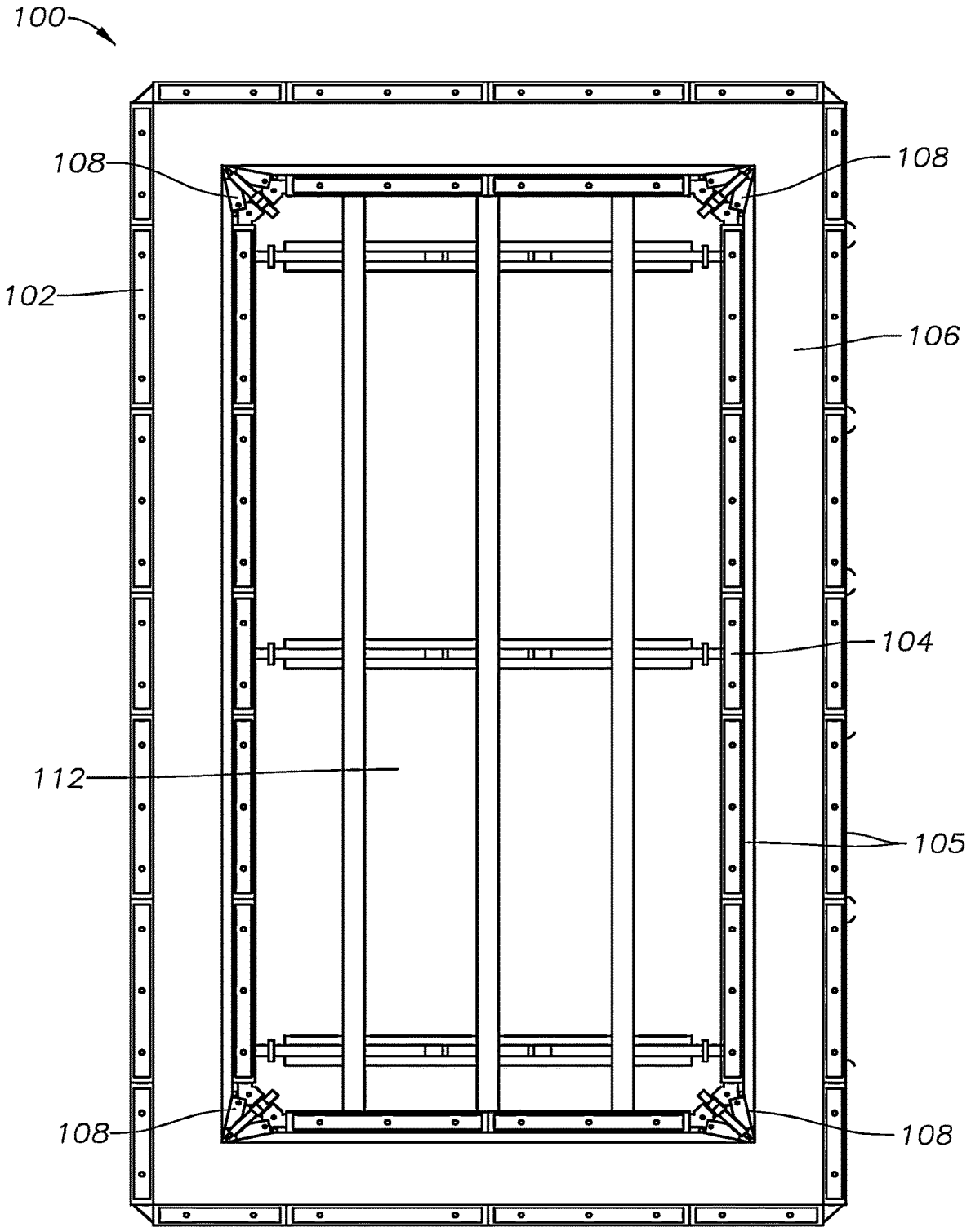
FIG. 1B illustrates the implementation of the formwork of FIG. 1A in a stripping position.

FIG. 1A illustrates an implementation 100 of formwork in a pour position. FIG. 1B illustrates the implementation of the formwork 100 in a stripping position. The formwork 100 may include an exterior structure 102 and an interior structure 104. The exterior structure 102 may include forms 105. The interior structure 104 may include forms 105 and stripping corners 108.

In the pour position, forming material 106 may be poured into the formwork 100 between the exterior structure 102 and the interior structure 104. For example, the exterior structure 102 and the interior structure may define a workspace 107 between them. The exterior structure 102 may be an outer boundary of the workspace 107 and the interior structure 104 may be an inner boundary of the workspace 107. Uncured forming material 106 may be poured into the workspace 107 and take on the shape defined by the exterior structure 102 and the interior structure 104.

The forms 105 of the exterior structure 102 may be positioned in a desired position relative to the forms 105 of the interior structure 104 and vice versa. For example, the thickness of the wall may be dictated by a distance between the exterior structure 102 and the interior structure 104. The distance between the forms may be maintained and stabilized by tie-rods 110. The stripping corners 108 couple adjacent forms 105 and, therefore, may help define the workspace 107.

Forming material 106 may be poured in the workspace 107 so that it assumes the form of the workspace 107. FIGS. 1A and 1B illustrate a substantially rectilinear formwork 100; however, the formwork 100 is not limited to a rectilinear configuration. The formwork 100 may have any shape such as a curved, polygonal, flat, irregular, circular, triangular, etc. The distance between forms 105 of the exterior structure 102 and the interior structure 104 is illustrated in FIGS. 1A and 1B as being substantially constant throughout an entirety of the formwork 100. However, it is not necessary that the distance between forms 105 of the exterior structure 102 and the interior structure 104 be constant. The distance between forms 105 of the exterior structure 102 and the interior structure 104 may be constant or irregular throughout the entirety of the formwork 100 or constant throughout some portions of the formwork 100 and irregular throughout other portions of the formwork 100.

As illustrated in FIG. 1B, after the material 106 within the workspace 107 cures, the formwork 100 may be removed from the material 106 and the cured material 106 may support itself. To remove the formwork 100, the tie rods 110 may be removed from the formwork 100. The exterior structure 102 may be pulled away from the cured material in a direction substantially perpendicular to the forms 105. The interior structure 104 may be retracted from the cured material 106 toward a center 112 of the formwork 100 by putting the stripping corners 108 in the stripping position. Each of the forms 105 of the interior structure 104 may be retracted toward the center 112 of the formwork 100 simultaneously. The stripping position, the structure of the stripping corners 108 and the operability of the stripping corners will be described in more detail below.

Figure 2A:
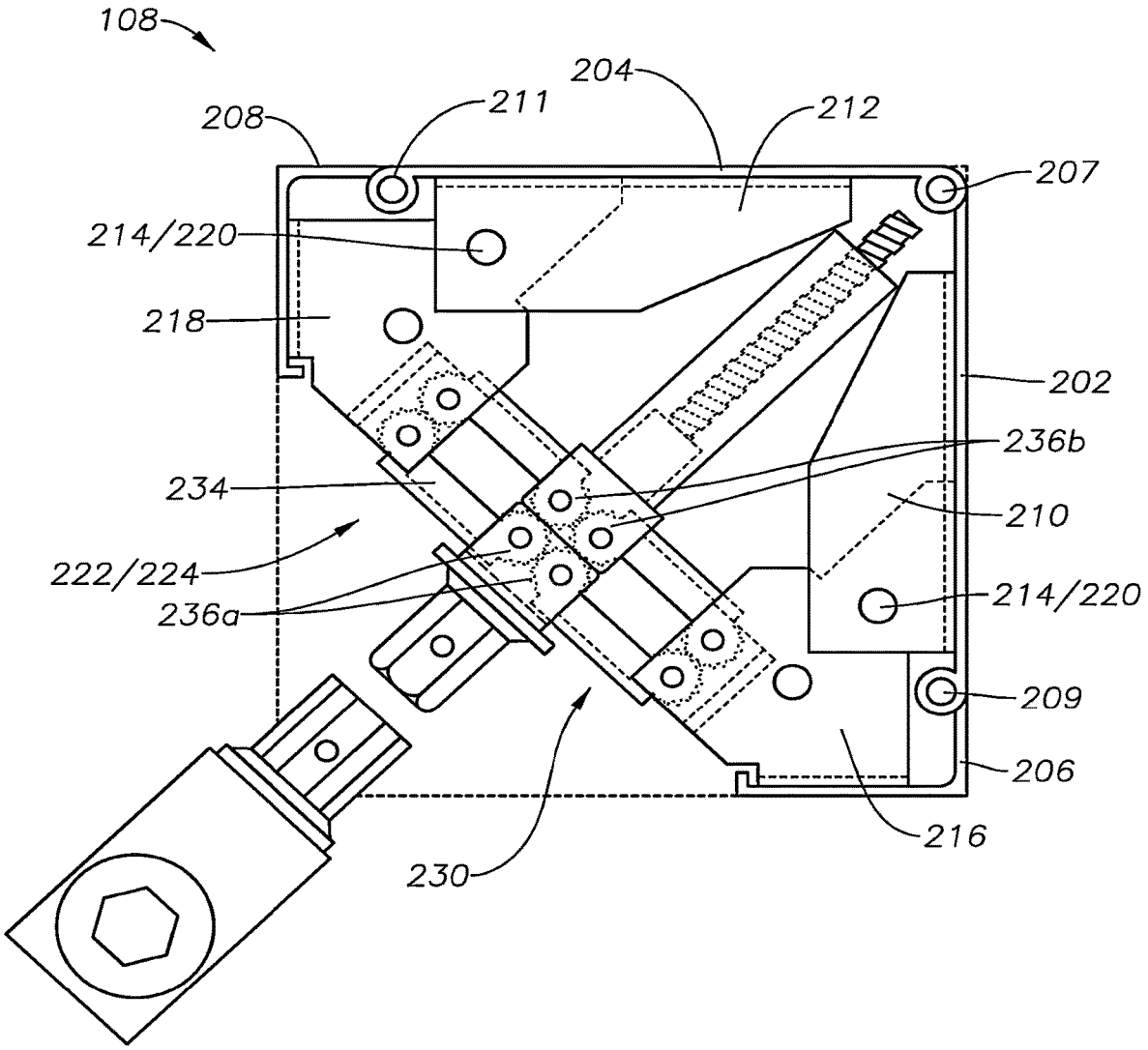
FIG. 2A illustrates an implementation of a stripping corner in a pour position.
Figure 2B:
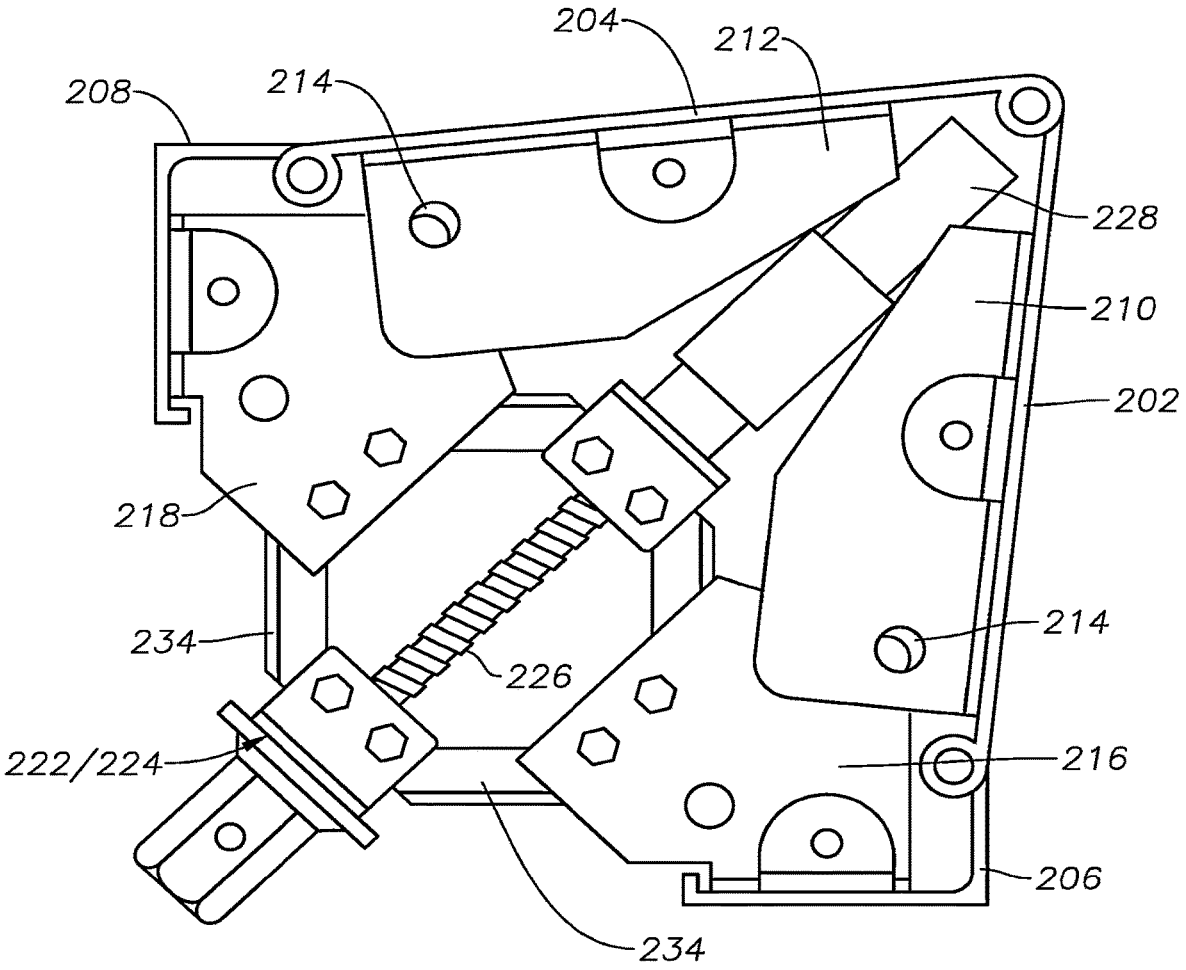
FIG. 2B illustrates an implementation of a stripping corner in an intermediate position.
Figure 2C:
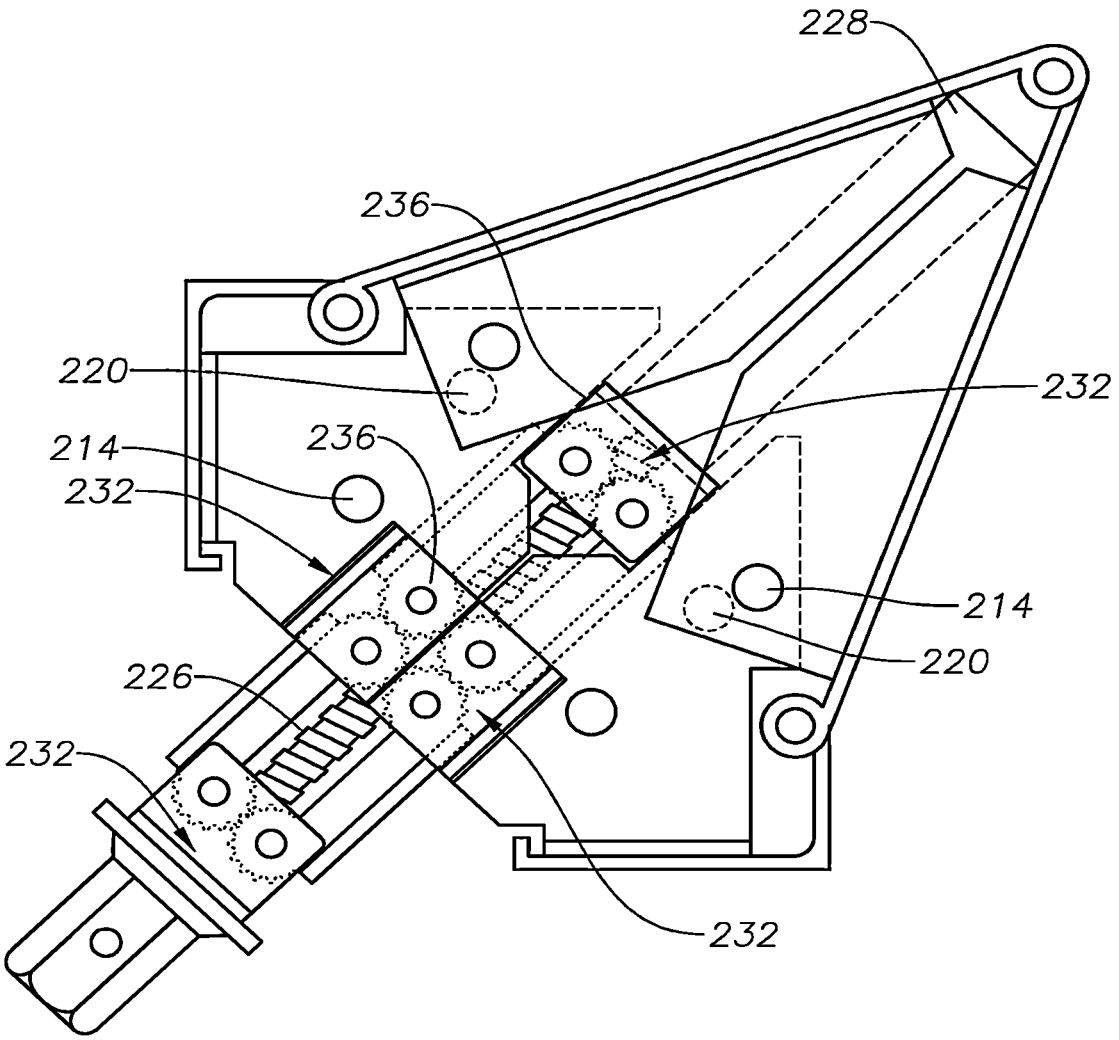
FIG. 2C illustrates an implementation of a stripping corner in a stripping position.

FIG. 2A illustrates the stripping corner 108 in the pour position. FIG. 2B illustrates the stripping corner 108 in an intermediate position. FIG. 2C illustrates the stripping corner 108 in a stripping position. The stripping corner 108 may include a first forward surface 202, a second forward surface 204, a first rearward surface 206 and a second rearward surface 208. The first forward surface 202 may be hingedly connected to the second forward surface 204 at hinge 207. The first forward surface 202 may be hingedly connected to the first rearward surface 206 at hinge 209. The second forward surface 204 may be hingedly connected to the second rearward surface 208 at hinge 211.

A first forward bracket 210 may be fixedly connected to the first forward surface 202 and a second forward bracket 212 may be fixedly connected to the second forward surface 208. The fixed connection between the forward brackets and the forward surfaces cause motion of each member of the connection to be shared by the other member of the connection. Each of the forward brackets 210 and 212 may define first through-holes 214 for receiving a respective locking pin (not shown).

A first rearward bracket 216 may be fixedly connected to the first rearward surface 206 and a second rearward bracket 218 may be fixedly connected to the second reward surface 208. The fixed connection between the rearward brackets and the rearward surfaces cause motion of each member of the connection to be shared by the other member of the connection. Each of the rearward brackets 216 and 218 may define second through-holes 220 for receiving a respective locking pin (not shown). When the stripping corner 108 is in a pour position, the first rearward through-holes 214 may align with the second through-holes 220 to lock the stripping corner 108 in the pour position.

An actuating mechanism 222, i.e., an extender, may connect the first rearward bracket 216 to the second rearward bracket 218. The actuating mechanism 222 may be a scissor jack, an accordion jack, a pneumatic jack, a screw jack, etc. A scissor jack 224 may include a threaded screw 226, a bolthead and a four-bar linkage 230. The threaded screw 226 may be coupled to the scissor jack 224 at a proximal end region of the threaded screw 226 and may be uncoupled to any element at a second end region of the threaded screw 226.

The actuating mechanism 222 may be controlled electronically and/or mechanically. For example, motion of the actuating mechanism 222 may be caused by the result of a force applied to the mechanism directly by a user or by a mechanical device such as a motor. Alternatively or additionally, motion of the actuating mechanism 222 may be caused by providing an electrical current to the actuating mechanism 222 (i.e., a linear motor within the actuator) causing it to extend or retract.

A tubular sheath 228 may be included around the threaded screw 226. The tubular sheath 228 may help protect the threaded screw 226 from inadvertent contact with forming material 106. For example, if forming material 106 contacts the threaded screw 226 and is allowed to cure, the threaded screw 226 may become inoperable for further use.

In an implementation including the scissor jack 224, ends 232 of each of links 234 of the four-bar linkage 230 may include gears 236. Gears of a first gear set 236*a* interact with each other and gears of a second gear set 236*b* interact with each other to ensure that the first rearward surface 206 is positioned substantially ninety degrees apart from the second rearward surface 208 regardless of whether the stripping corner 108 is in a pour position or a stripping position.

The scissor jack 224 may operate by responding to rotation of the screw 226. For example, when the screw 226 is rotated in a first direction, the links 234 will separate from each other from the position illustrated in FIG. 2A toward the position illustrated in FIG. 2B and reconverge toward the position illustrated in FIG. 2C. The surfaces 202, 204, 206 and 208, therefore, converge toward each other due to their connection to the scissor jack 224. When the screw 226 is rotated in a second direction, opposing the first direction, the links 234 will separate from the position illustrated in FIG. 2C toward illustrated in FIG. 2B and reconverge toward each other from the position illustrated in FIG. 2B toward the positions illustrated in FIG. 2A. The surfaces 202, 204, 206 and 208, therefore, are urged away from each other due to their connection to the scissor jack 224. Thus, rotation in the first direction or the second direction translates motion from the screw 226 to the links 234 to the first rearward bracket 216 and the second rearward bracket 218 to, respectively, the first rearward surface 206 and the second rearward surface 208.

Figure 3A:
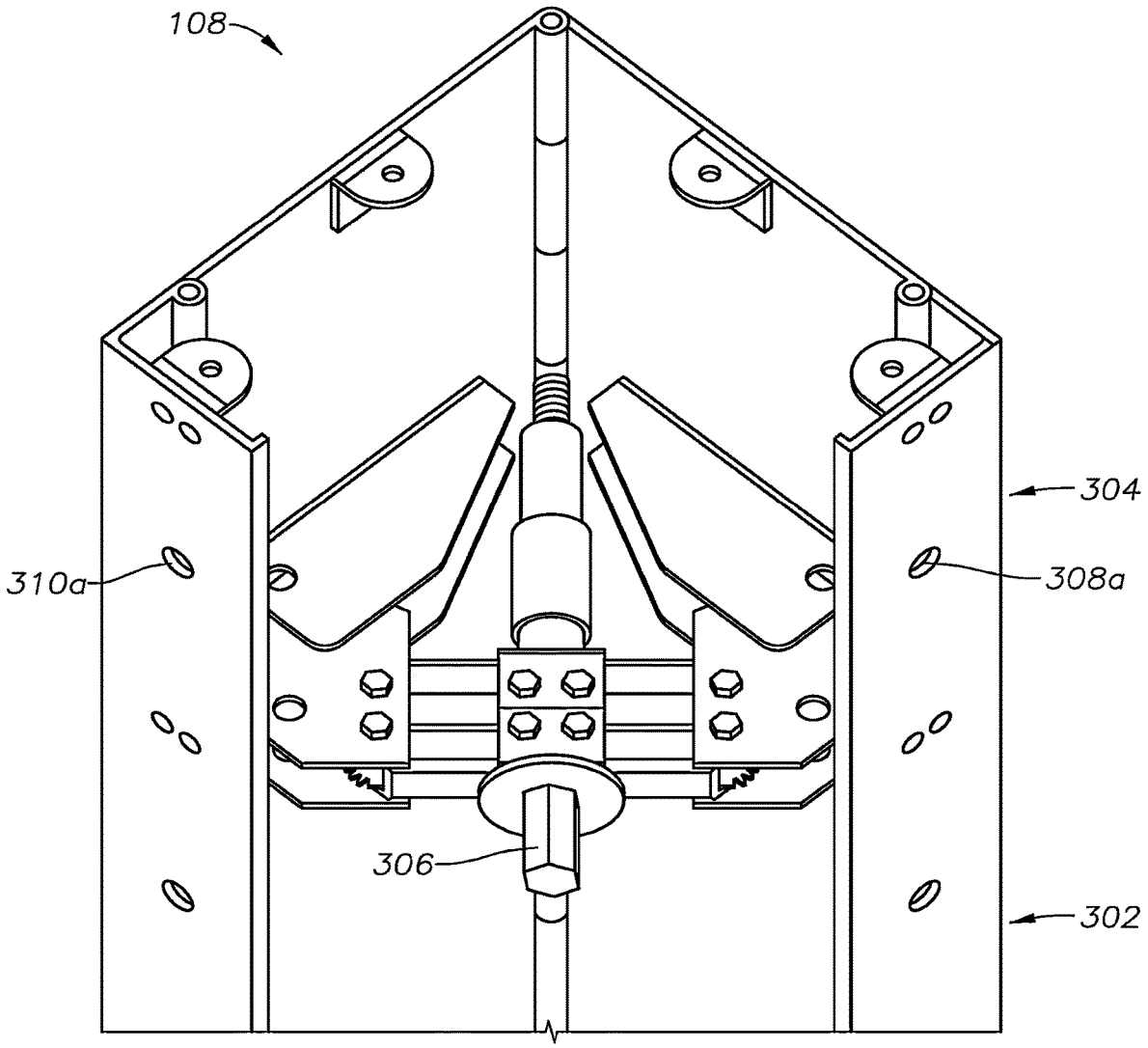
FIG. 3A illustrates a perspective view of the stripping corner in a pour position.
Figure 3B:
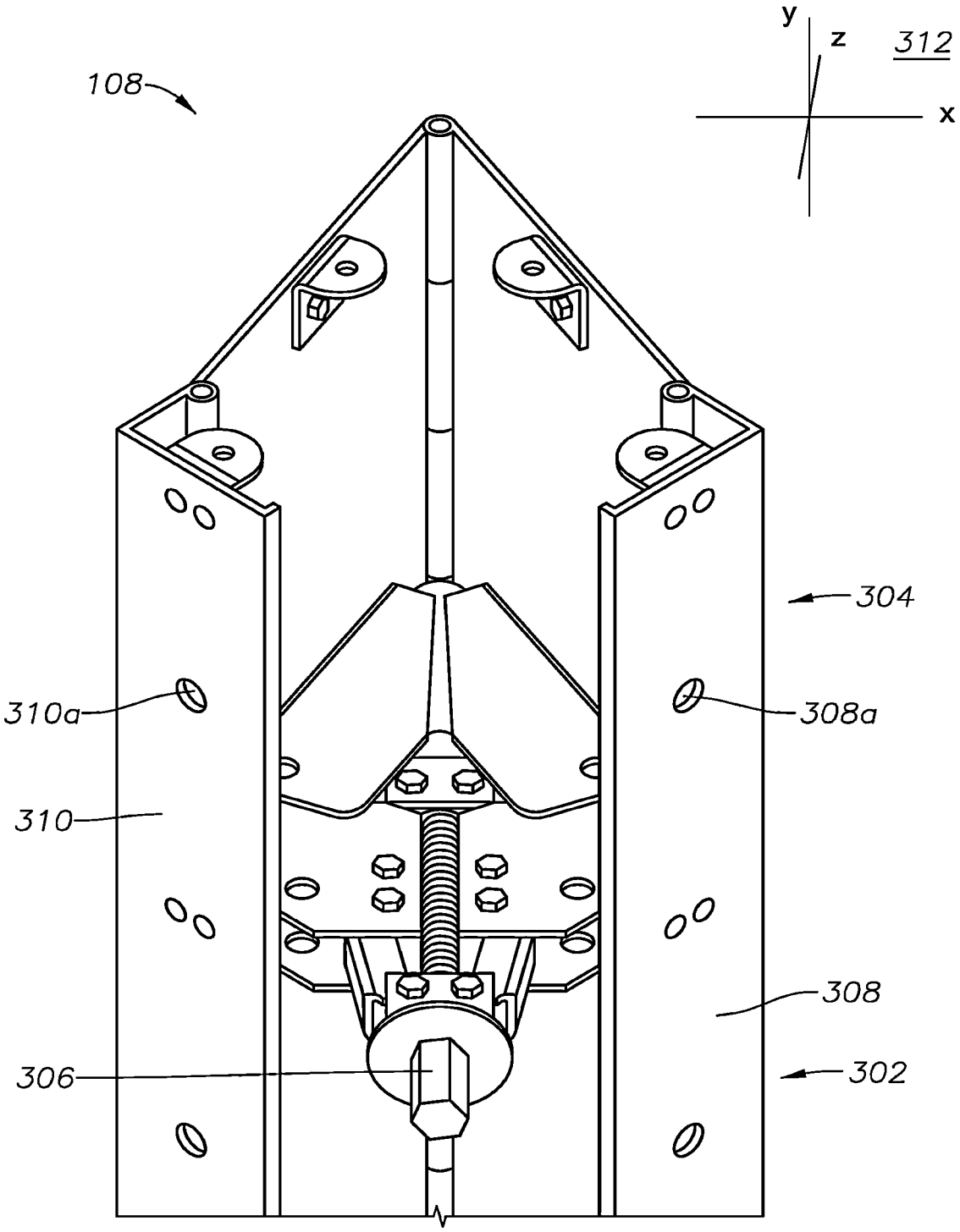
FIG. 3B illustrates a perspective view of the stripping corner of FIG. 3A in a stripping position.

FIGS. 3A and 3B illustrate perspective views of the stripping corner 108. The stripping corner 108 is illustrated in a pour position in FIG. 3A and it is illustrated in a stripping position in FIG. 3B. Although, FIGS. 3A and 3B illustrate a single set of brackets and scissor jacks, multiple sets of brackets and scissor jacks may be used with a single stripping corner. For example, second and third sets of brackets and scissor jacks may be placed, respectively, at a second position 302 and a third position 304.

Providing multiple actuating mechanisms 222 connected to additional brackets may provide a uniform withdrawal of the stripping corner 108 from a cured surface. For example, a stripping corner 108 having multiple actuating mechanisms 222 placed in multiple positions between ends of the stripping corner may be actuated simultaneously to withdraw the entire stripping corner from a surface of the cured forming material 106 with one applied force instead of withdrawing a portion of the stripping corner 108 with a first force and then withdrawing a different portion of the stripping corner with a second force, withdrawing a yet further portion of the stripping corner with a third force, etc.

It is not necessary that the entire stripping corner be withdrawn from the surface of the cured forming material 106 using a single withdrawal force. Multiple actuating mechanisms may be operated independently from each other and in no particular order rather than simultaneously so that different portions of the stripping corner may be withdrawn from the surface of the cured forming material 106 at different times.

Withdrawal of the stripping corner 108 from a surface of the cured forming material 106 may also cause the forms 105 to withdraw from the surface of the cured forming material 106. For example, one form 105 may be connected to a third rearward surface 308 and another form 105 may be connected to a fourth rearward surface 310. A connection may be maintained by connecting fasteners (not shown) through third rearward surface through-holes 308*a* and through fourth rearward surface through-holes 310*a*. Due to the connection between the forms 105 and the stripping corner 108, adjusting the stripping corner 108 from the pour position to the stripping position may cause the forms to move from a pour position in which the forms 105 are in contact with the forming material 106 to a stripping position in which the forms 105 are withdrawn from contact with the forming material 106.

To impart motion on the screw 226, bolthead 306 may be fixedly attached to an end of the screw 226 in that the bolthead 306 rotates as a result of rotation of the screw 226 and the screw 226 rotates as a result of rotation of the bolthead 306. In some embodiments, bolthead 306 may be a uniform cylinder or it may have a multi-faced cross-section, i.e., hexagonal, square, triangular, rectangular, etc. In further embodiments, the bolthead 306 may have a torque receiving recess on an end of the bolthead. For example, the torque receiving recess may be configured to receive a Philips head screw bit, a flat head screw bit, an Allen wrench bit, etc.

Applying a wrench or other torque mechanism to the bolthead 306 may be sufficient to rotate the screw 226. If multiple sets of brackets and scissor jacks are used in a single stripping corner, each bolthead of each set of brackets and scissor jacks may be simultaneously rotated by applying a single point stripping tool, i.e., a multiple head torque mechanism, to all of the bolts at once.

In some implementations, a vector of an input force applied to the bolthead 306 by the single point stripping tool may be in the same direction as a vector of an output force acting on the first rearward bracket 216 and on the second rearward bracket 218. Therefore, the input force vector may be parallel with the output force vector. In other implementations, the vector of the input force applied to the bolthead 306 by the single point stripping tool may be in a crosswise direction from the vector of the output force acting on the first rearward bracket 216 and on the second rearward bracket 218. For example, input may be applied rotationally about a z-axis of the coordinate axis 312 and output may be provided linearly about an x-axis of the coordinate axis 312. The axes of input and output force vectors may, therefore, be substantially perpendicular to each other.

A single point stripping tool may be one in which input from a single torque mechanism (wrench, driver, etc.) may be translated to each of multiple sockets, wrenches, drivers, etc. to rotate all of the bolts at once, thereby enabling the simultaneous rotation of each bolthead of a respective stripping corner bracket set.

Figure 4A:
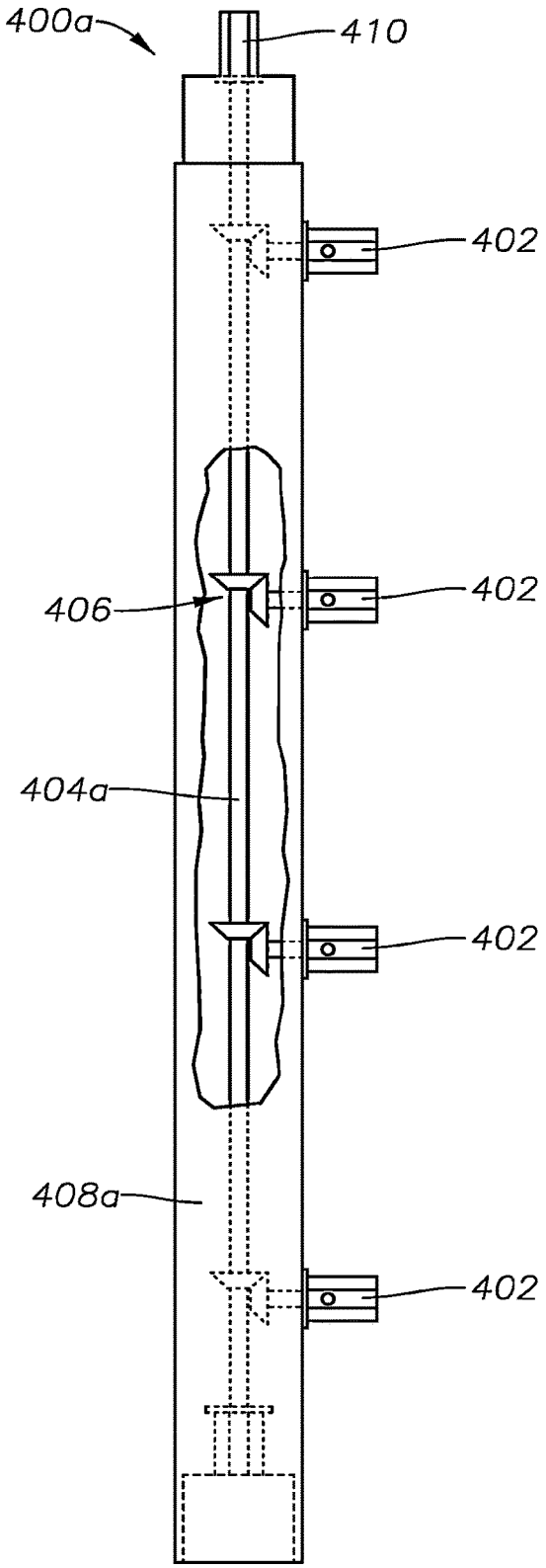
FIGS. 4A and 4B illustrate implementations of a single point stripping tool.
Figure 4B:
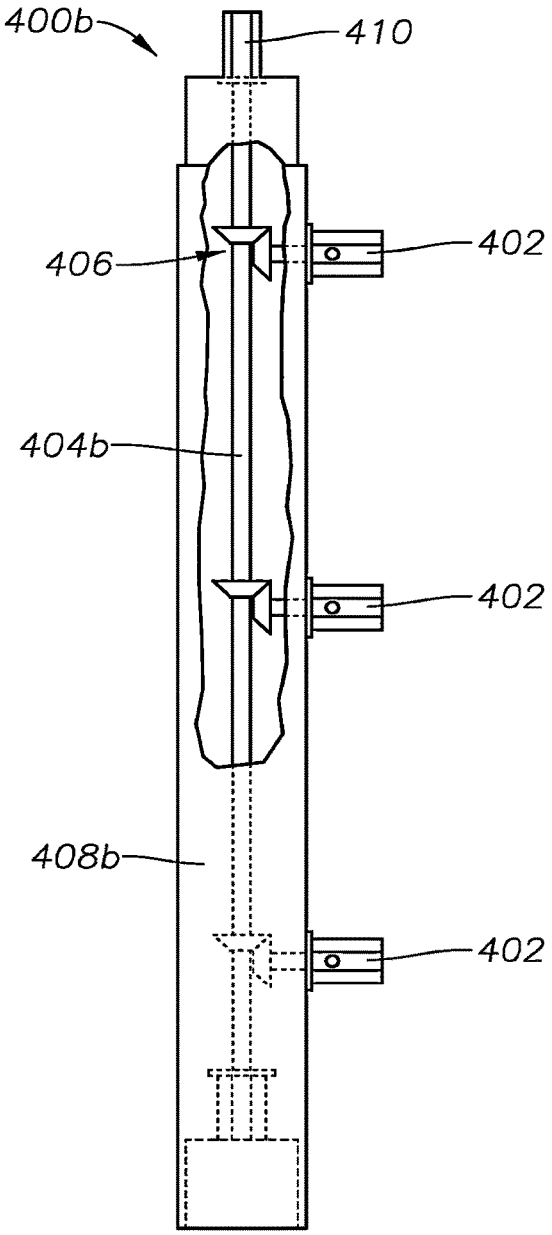

FIGS. 4A and 4B illustrate first and second implementations 400*a* and 400*b*, respectively, of a single point stripping tool having multiple outputs. For example, a single point stripping tool having multiple outputs may include shafts 404*a* or 404*b* and bevel gearing 406 contained in a sealed housing 408*a* or 408*b*.

The number of outputs may vary depending on the application. For example, single point stripping tool 400*a* illustrated in FIG. 4A may include a single torque input bolthead 410 and four torque output sockets 402. Single point stripping tool 400*b* may include a single input bolthead 410 and three outputs 402.

The bevel gears 406 may be included to translate rotation about a first axis parallel to the shafts 404*a* or 404*b* to rotation about a second axis that may be substantially perpendicular to the first axis. The gear ratio may be 1:1 wherein rotation at an input equals rotation at the output. Rotation may be instead be such that rotation at the input results in a greater rotation at the output or vice versa. The inputs and/or outputs may be a male/female hex socket arrangement.

It is not necessary that translation from the first axis to the second axis be via bevel gearing 406. Rotational translation may be accomplished via electronic signaling from a controller wherein the controller receives a signal indicative of a rotational direction and magnitude and sends a signal to each of the outputs to rotate with a corresponding direction and magnitude, i.e., substantially within an acceptable input/output ratio.

In the appended figures, similar components and/or features may have the same reference label. Further, various components of the same type may be distinguished by following the reference label by a letter that distinguishes among the similar components. If only the first reference label is used in the specification, the description is applicable to any one of the similar components having the same first reference label irrespective of the second reference label.

The discussion above is directed to certain specific implementations. It is to be understood that the discussion above is only for the purpose of enabling a person with ordinary skill in the art to make and use any subject matter defined now or later by the patent "claims" found in any issued patent herein.

It is specifically intended that the claimed invention is not limited to the implementations and illustrations contained herein but include modified forms of those implementations including portions of the implementations and combinations of elements of different implementations as come within the scope of the following claims. It should be appreciated that in the development of any such actual implementation, as in any engineering or design project, numerous implementation-specific decisions may be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure. Nothing in this application is considered critical or essential to the claimed invention unless explicitly indicated as being "critical" or "essential."

In the above detailed description, numerous specific details were set forth in order to provide a thorough understanding of the present disclosure. However, it will be apparent to one of ordinary skill in the art that the present disclosure may be practiced without these specific details. In other instances, well-known methods, procedures, components, circuits and networks have not been described in detail so as not to unnecessarily obscure aspects of the implementation.

It will also be understood that, although the terms first, second, etc. may be used herein to describe various elements, these elements should not be limited by these terms. These terms are only used to distinguish one element from another. For example, a first object or step could be termed a second object or step, and, similarly, a second object or step could be termed a first object or step, without departing from the scope of the invention. The first object or step, and the second object or step, are both objects or steps, respectively, but they are not to be considered the same object or step.

The terminology used in the description of the present disclosure herein is for the purpose of describing particular implementations only and is not intended to be limiting of the present disclosure. As used in the description of the present disclosure and the appended claims, the singular forms "a," "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises" and/or "comprising," when used in this specification, specify the presence of stated features, integers, steps, operations, elements, and/or components, but do not preclude the presence or addition of one or more other features, integers, steps, operations, elements, components and/or groups thereof.

As used herein, the term "if" may be construed to mean "when" or "upon" or "in response to determining" or "in response to detecting," depending on the context. Similarly, the phrase "if it is determined" or "if [a stated condition or event] is detected" may be construed to mean "upon determining" or "in response to determining" or "upon detecting [the stated condition or event]" or "in response to detecting [the stated condition or event]," depending on the context. As used herein, the terms "up" and "down"; "upper" and "lower"; "upwardly" and downwardly"; "below" and "above"; and other similar terms indicating relative positions above or below a given point or element may be used in connection with some implementations of various technologies described herein.

While the foregoing is directed to implementations of various techniques described herein, other and further implementations may be devised without departing from the basic scope thereof, which may be determined by the claims that follow. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

The invention claimed is:

1. A torquing mechanism comprising:

a single torque input unit rotatable along a first axis; and a plurality of torque output units that simultaneously actuate in response to actuation of the single torque input unit, the plurality of torque output units being rotatable about a plurality of second axes, wherein an amount of actuation and an angular displacement relative to a starting position of each of the plurality of torque output units is substantially equal, wherein the first axis is transverse to the plurality of second axes, wherein the plurality of torque output units rotate in the same direction about the plurality of second axes.

2. The torquing mechanism of claim 1, further comprising a shaft fixedly attached to the single torque input units, the shaft being rotatable along the first axis.

3. The torquing mechanism of claim 2, the shaft comprising a plurality of first bevel gears fixedly attached to the shaft, the plurality of torque output units having a plurality of second bevel gears, wherein the plurality of first bevel gears and the plurality of second bevel gears interface to provide rotational translation between the single torque input unit and the plurality of torque output units.

4. The torquing mechanism of claim 3, the plurality of torque output units being a plurality of torque output sockets.

5. The torquing mechanism of claim 4, the single torque input unit being a single unput bolthead.

6. The torquing mechanism of claim 4, the single torque input unit being of a hex socket arrangement.

7. The torquing mechanism of claim 1, the plurality of torque output units being of a hex socket arrangement.

8. The torquing mechanism of claim 1, the plurality of torque output units being three torque output units.

9. The torquing mechanism of claim 1, the plurality of torque output units being four torque output units.

10. The torquing mechanism of claim 4, the plurality of torque output units being of a hex socket arrangement.

11. The torquing mechanism of claim 10, further comprising a sealed housing, wherein the plurality of first bevel gears and the plurality of second bevel gears are contained within the sealed housing.

* * * * *